US005931342A

United States Patent [19]

Taylor

[11] Patent Number: 5,931,342

[45] Date of Patent: Aug. 3, 1999

[54] HEAT WRAP FOR CARBON DIOXIDE TANKS

[76] Inventor: Eric Taylor, 104 River Dr., Millville, N.J. 08332

[21] Appl. No.: 09/031,428

[22] Filed: Feb. 26, 1998

[51] Int. Cl.[6] ..... H05B 1/02

[52] U.S. Cl. ..... 222/5; 222/88; 222/89; 222/131; 222/146.5; 219/528; 219/535; 219/536

[58] Field of Search ..... 222/3, 5, 83.5, 222/88, 89, 91, 131, 146.5; 137/341; 219/528, 529, 535, 536, 549

[56] References Cited

U.S. PATENT DOCUMENTS

| | | | |
|---|---|---|---|
| 2,552,783 | 5/1951 | Harper | 222/146.5 |
| 3,079,486 | 2/1963 | Winchell | 219/528 |
| 3,933,276 | 1/1976 | Packham et al. | 222/146.5 |
| 4,211,251 | 7/1980 | Rickert et al. | 219/535 |
| 4,912,303 | 3/1990 | Beavers et al. | 219/535 |
| 5,197,595 | 3/1993 | Coultas | 219/529 |
| 5,827,050 | 10/1998 | Price | 219/528 |

*Primary Examiner*—J. Casimer Jacyna

[57] ABSTRACT

A new heat wrap for carbon dioxide tanks for improving performance of a paint ball gun by increasing length of use of a carbon dioxide tank. The inventive device includes a blanket having a generally rectangular configuration. The blanket has an inner surface and an outer surface. The blanket wraps around a carbon dioxide tank. A heating element is disposed interiorly of the blanket and being disposed around a substantial area of the blanket. The heating element has a power source. A cylindrical cap is secured to an upper short edge of the blanket. The cylindrical cap has an open upper end and an open lower end with a flow channel therebetween. The open lower end is dimensioned for coupling with an upper end of the carbon dioxide tank. A pressure switch is disposed within the cylindrical cap. The pressure switch is in communication with the heating element whereby a reduced pressure of carbon dioxide will activate the heating element to provide heat and increase the pressure of the carbon dioxide.

5 Claims, 2 Drawing Sheets

HEAT WRAP FOR CARBON DIOXIDE TANKS

BACKGROUND OF THE INVENTION

1. Field of the Invention

The present invention relates to pressure controls for gas and more particularly pertains to a new heat wrap for carbon dioxide tanks for improving performance of a paint ball gun by increasing length of use of a carbon dioxide tank.

2. Description of the Prior Art

The use of pressure controls for gas is known in the prior art. More specifically, pressure controls for gas heretofore devised and utilized are known to consist basically of familiar, expected and obvious structural configurations, notwithstanding the myriad of designs encompassed by the crowded prior art which have been developed for the fulfillment of countless objectives and requirements.

Known prior art pressure controls for gas include U.S. Pat. No. 5,257,640 to Delajoud; U.S. Pat. No. 4,386,261 to Berglund et al.; U.S. Pat. No. 4,627,822 to Esposito; U.S. Pat. No. 4,083,340 to Furr et al.; U.S. Pat. No. 4,634,838 to Berz; and U.S. Pat. No. Des. 351,337 to Bonnema et al.

While these devices fulfill their respective, particular objectives and requirements, the aforementioned patents do not disclose a new heat wrap for carbon dioxide tanks. The inventive device includes a blanket having a generally rectangular configuration. The blanket has an inner surface and an outer surface. The blanket wraps around a carbon dioxide tank. A heating element is disposed interiorly of the blanket and being disposed around a substantial area of the blanket. The heating element has a power source. A cylindrical cap is secured to an upper short edge of the blanket. The cylindrical cap has an open upper end and an open lower end with a flow channel therebetween. The open lower end is dimensioned for coupling with an upper end of the carbon dioxide tank. A pressure switch is disposed within the cylindrical cap. The pressure switch is in communication with the heating element whereby a reduced pressure of carbon dioxide will activate the heating element to provide heat and increase the pressure of the carbon dioxide.

In these respects, the heat wrap for carbon dioxide tanks according to the present invention substantially departs from the conventional concepts and designs of the prior art, and in so doing provides an apparatus primarily developed for the purpose of improving performance of a paint ball gun by increasing length of use of a carbon dioxide tank.

SUMMARY OF THE INVENTION

In view of the foregoing disadvantages inherent in the known types of pressure controls for gas now present in the prior art, the present invention provides a new heat wrap for carbon dioxide tanks construction wherein the same can be utilized for improving performance of a paint ball gun by increasing length of use of a carbon dioxide tank.

The general purpose of the present invention, which will be described subsequently in greater detail, is to provide a new heat wrap for carbon dioxide tanks apparatus and method which has many of the advantages of the pressure controls for gas mentioned heretofore and many novel features that result in a new heat wrap for carbon dioxide tanks which is not anticipated, rendered obvious, suggested, or even implied by any of the prior art pressure controls for gas, either alone or in any combination thereof.

To attain this, the present invention generally comprises a blanket having a generally rectangular configuration. The blanket has an inner surface and an outer surface. The inner surface has a pair of hook and loop strips disposed inwardly of a long side edge of the blanket and the outer surface has a pair of hook and loop strips disposed inwardly of an opposing long side edge of the blanket for selective mating when the blanket is wrapped around a carbon dioxide tank. A heating element is disposed interiorly of the blanket and is disposed around a substantial area of the blanket. The heating element has an electrical plug extending outwardly thereof for coupling with an electrical outlet. A cylindrical cap is secured to an upper short edge of the blanket. The cylindrical cap has an open upper end and an open lower end with a flow channel therebetween. The open lower end is dimensioned for coupling with an upper end of the carbon dioxide tank. The flow channel has a spike disposed therein directed towards the open lower end. The spike serves to penetrate a seal on the carbon dioxide tank. A pressure switch is disposed within the cylindrical cap. The pressure switch is in communication with the heating element whereby a reduced pressure of carbon dioxide will activate the heating element to provide heat and increase the pressure of the carbon dioxide.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new heat wrap for carbon dioxide tanks apparatus and method which has many of the advantages of the pressure controls for gas mentioned heretofore and many novel features that result in a new heat wrap for carbon dioxide tanks which is not anticipated, rendered obvious, suggested, or even implied by any of the prior art pressure controls for gas, either alone or in any combination thereof.

It is another object of the present invention to provide a new heat wrap for carbon dioxide tanks which may be easily and efficiently manufactured and marketed.

It is a further object of the present invention to provide a new heat wrap for carbon dioxide tanks which is of a durable and reliable construction.

An even further object of the present invention is to provide a new heat wrap for carbon dioxide tanks which is susceptible of a low cost of manufacture with regard to both materials and labor, and which accordingly is then susceptible of low prices of sale to the consuming public, thereby making such heat wrap for carbon dioxide tanks economically available to the buying public.

Still yet another object of the present invention is to provide a new heat wrap for carbon dioxide tanks which provides in the apparatuses and methods of the prior art some of the advantages thereof, while simultaneously overcoming some of the disadvantages normally associated therewith.

Still another object of the present invention is to provide a new heat wrap for carbon dioxide tanks for improving performance of a paint ball gun by increasing length of use of a carbon dioxide tank.

Yet another object of the present invention is to provide a new heat wrap for carbon dioxide tanks which includes a blanket having a generally rectangular configuration. The blanket has an inner surface and an outer surface. The blanket wraps around a carbon dioxide tank. A heating element is disposed interiorly of the blanket and being disposed around a substantial area of the blanket. The heating element has a power source. A cylindrical cap is secured to an upper short edge of the blanket. The cylindrical cap has an open upper end and an open lower end with a flow channel therebetween. The open lower end is dimensioned for coupling with an upper end of the carbon dioxide tank. A pressure switch is disposed within the cylindrical cap. The pressure switch is in communication with the heating element whereby a reduced pressure of carbon dioxide will activate the heating element to provide heat and increase the pressure of the carbon dioxide.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
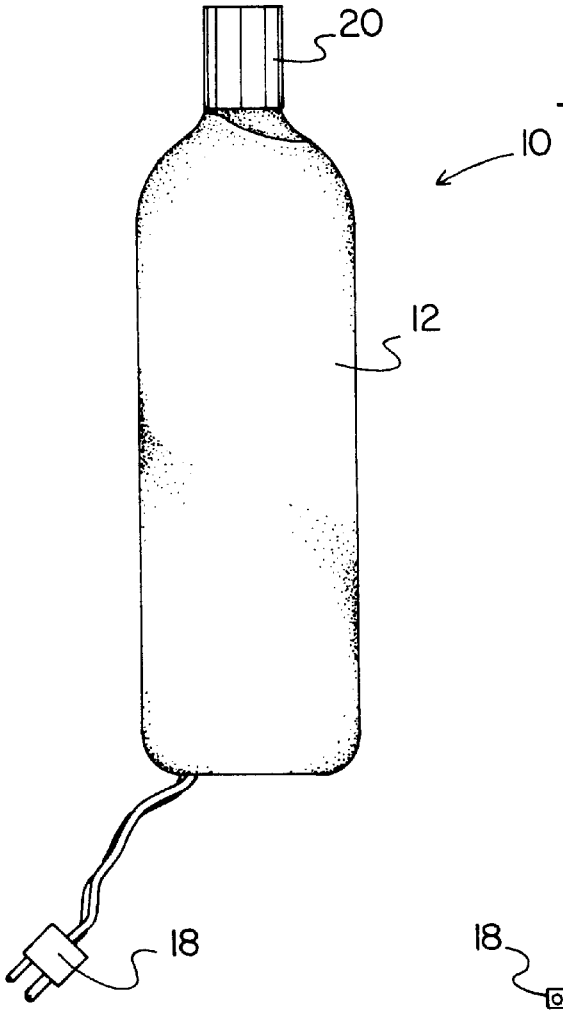
FIG. 1 is a front elevation view of a new heat wrap for carbon dioxide tanks according to the present invention.
Figure 2:
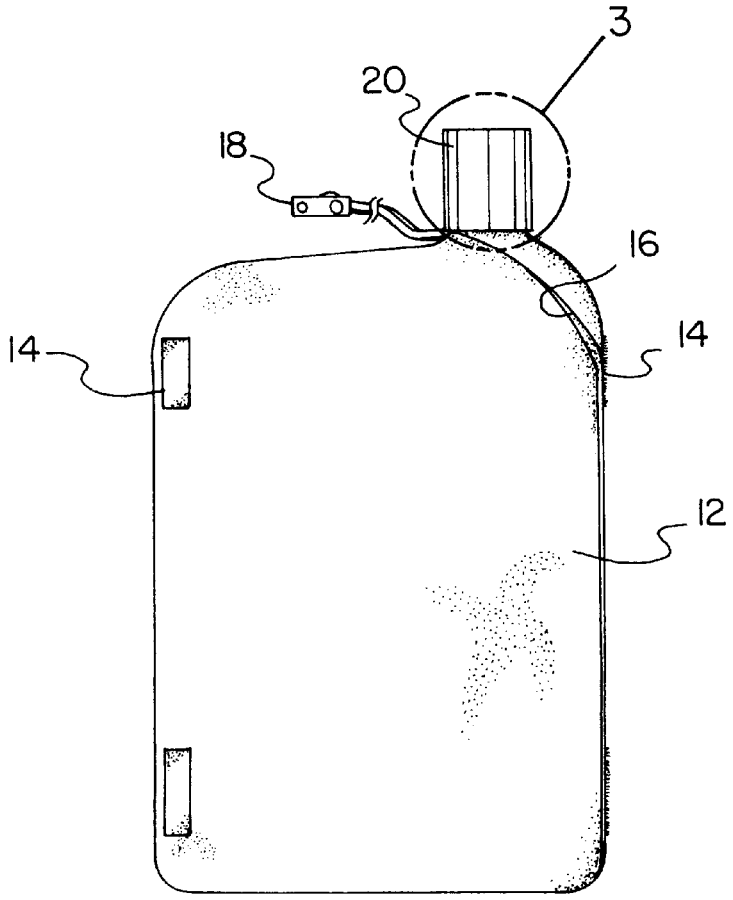
FIG. 2 is a front elevation view of the present invention illustrated detached from the gas canister.
Figure 3:
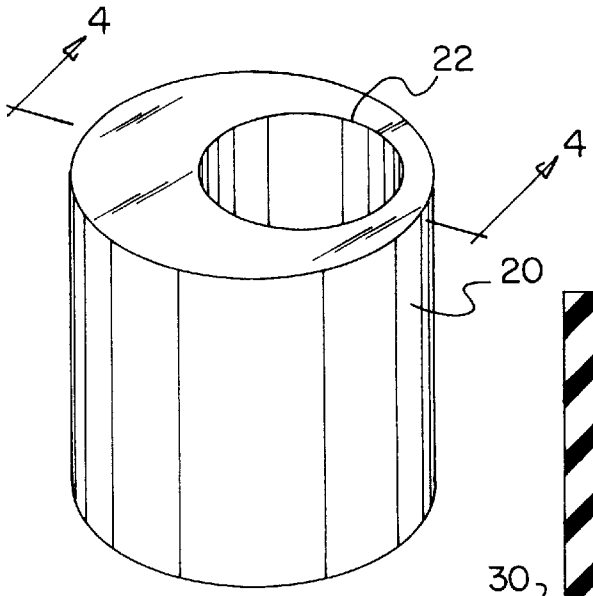
FIG. 3 is a perspective view of the cylindrical cap of the present invention.
Figure 4:
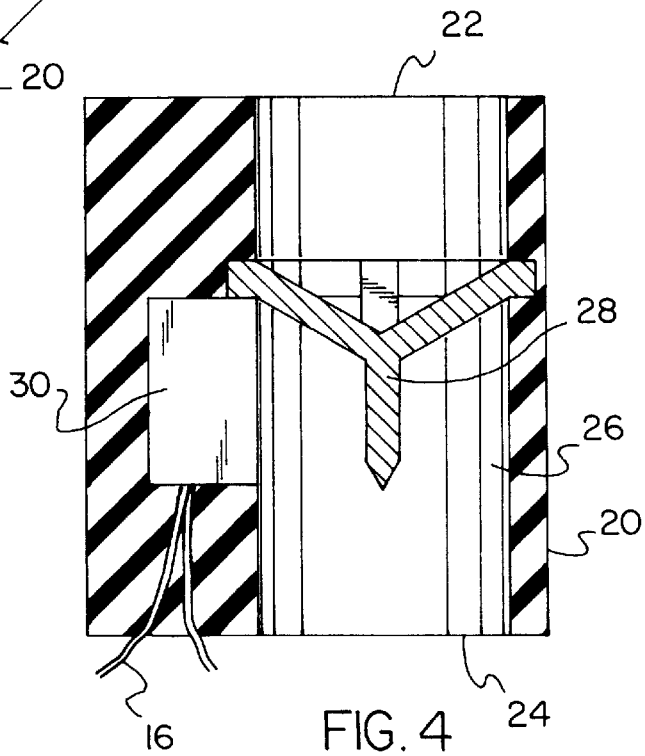
FIG. 4 is a cross-sectional view of the present invention as taken along line 4—4 of FIG. 3.
Figure 5:
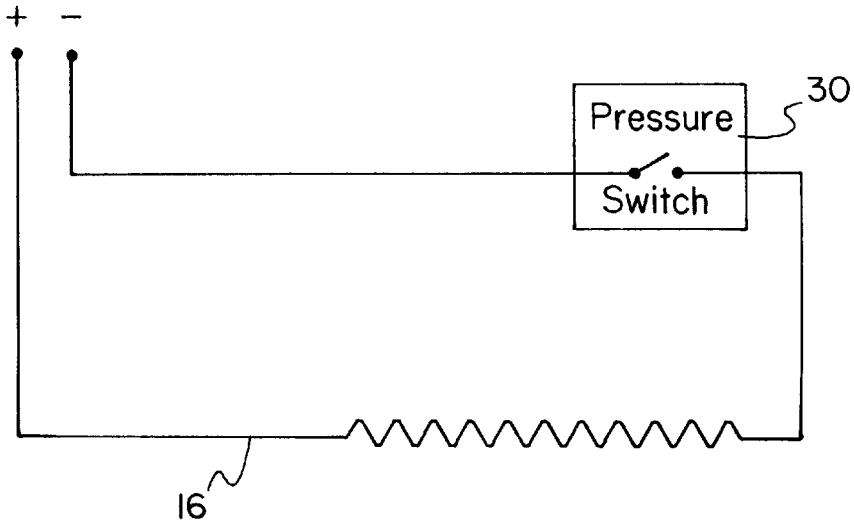
FIG. 5 is a schematic view of the present invention.

With reference now to the drawings, and in particular to FIGS. 1 through 5 thereof, a new heat wrap for carbon dioxide tanks embodying the principles and concepts of the present invention and generally designated by the reference numeral 10 will be described.

As best illustrated in FIGS. 1 through 5, the heat wrap for carbon dioxide tanks 10 comprises a blanket 12 having a generally rectangular configuration. The blanket has an inner surface and an outer surface. The inner surface has a pair of hook and loop strips 14 disposed inwardly of a long side edge of the blanket 12 and the outer surface has a pair of hook and loop strips 14 disposed inwardly of an opposing long side edge of the blanket for selective mating when the blanket 12 is wrapped around a carbon dioxide tank.

A heating element 16 is disposed interiorly of the blanket 12 and is disposed around a substantial area of the blanket 12. The heating element 16 has an electrical plug 18 extending outwardly thereof for coupling with an electrical outlet.

A cylindrical cap 20 is secured to an upper short edge of the blanket 12. The cylindrical cap 20 has an open upper end 22 and an open lower end 24 with a flow channel 26 therebetween. The open lower end 24 is dimensioned for coupling with an upper end of the carbon dioxide tank. The flow channel 26 has a spike 28 disposed therein directed towards the open lower end 24. The spike 28 serves to penetrate a seal on the carbon dioxide tank.

A pressure switch 30 is disposed within the cylindrical cap 20. The pressure switch 30 is in communication with the heating element 16 whereby a reduced pressure of carbon dioxide will activate the heating element 16 to provide heat and increase the pressure of the carbon dioxide.

In use, the present invention would improve the performance of a paint ball gun by allowing the carbon dioxide tank to last longer.

The concept would involve wrapping a length of nicrom wire 16 around an air tank and connecting the wire 16 to a power source, such as an electrical outlet or a rechargeable battery pack, to create a heating element 16 where current flowing through the wire would heat the tank and raise the pressure of the gas inside. The blanket 12 would be wrapped around the heating element 16 so that most of the heat is absorbed by the tank. The pressure valve 30 would be included to monitor the remaining air pressure in the tank, so that once the air pressure drops below a predetermined level, the heating element 16 could be activated to heat the remaining gas and raise it's pressure.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A new heat wrap for carbon dioxide tanks for improving performance of a paint ball gun by increasing length of use of a carbon dioxide tank comprising, in combination:

a blanket having a generally rectangular configuration, the blanket having an inner surface and an outer surface, the inner surface having a pair of hook and loop strips disposed inwardly of a long side edge of the blanket and the outer surface having a pair of hook and loop strips disposed inwardly of an opposing long side edge of the blanket for selective mating when the blanket is wrapped around a carbon dioxide tank;

a heating element disposed interiorly of the blanket and being disposed around a substantial area of the blanket, the heating element having an electrical plug extending outwardly thereof for coupling with an electrical outlet;

a cylindrical cap secured to an upper short edge of the blanket, the cylindrical cap having an open upper end and an open lower end with a flow channel therebetween, the open lower end dimensioned for coupling with an upper end of the carbon dioxide tank, the flow channel having a spike disposed therein directed towards the open lower end, the spike serving to penetrate a seal on the carbon dioxide tank; and a pressure switch disposed within the cylindrical cap, the pressure switch being in communication with the heating element whereby a reduced pressure of carbon dioxide will activate the heating element to provide heat and increase the pressure of the carbon dioxide.

2. A new heat wrap for carbon dioxide tanks for improving performance of a paint ball gun by increasing length of use of a carbon dioxide tank comprising, in combination:

a blanket having a generally rectangular configuration, the blanket having an inner surface and an outer surface, the blanket wrapping around a carbon dioxide tank;

a heating element disposed interiorly of the blanket and being disposed around a substantial area of the blanket, the heating element having a power source;

a cylindrical cap secured to an upper short edge of the blanket, the cylindrical cap having an open upper end and an open lower end with a flow channel therebetween, the open lower end dimensioned for coupling with an upper end of the carbon dioxide tank; and a pressure switch disposed within the cylindrical cap, the pressure switch being in communication with the heating element whereby a reduced pressure of carbon dioxide will activate the heating element to provide heat and increase the pressure of the carbon dioxide.

3. The heat wrap for carbon dioxide tanks as set forth in claim 2 wherein the inner surface has a pair of hook and loop strips disposed inwardly of a long side edge of the blanket and the outer surface having a pair of hook and loop strips disposed inwardly of an opposing long side edge of the blanket for selective mating when the blanket is wrapped around a carbon dioxide tank.

4. The heat wrap for carbon dioxide tanks as set forth in claim 2 wherein the power source is an electrical plug extending outwardly of the blanket for coupling with an electrical outlet.

5. The heat wrap for carbon dioxide tanks as set forth in claim 2 wherein the flow channel has a spike disposed therein directed towards the open lower end, the spike serving to penetrate a seal on the carbon dioxide tank.

* * * * *